United States Patent [19]

Friesen

[11] Patent Number: 4,538,388

[45] Date of Patent: Sep. 3, 1985

[54] POSITIVELY VENTED FLAT ROOF SYSTEM

[75] Inventor: Paul F. Friesen, Lancaster, Pa.

[73] Assignee: Armstrong World Industries, Inc., Lancaster, Pa.

[21] Appl. No.: 464,390

[22] Filed: Feb. 7, 1983

[51] Int. Cl.[3] ..... E04B 7/00

[52] U.S. Cl. ..... 52/199; 52/303; 52/408

[58] Field of Search ..... 52/199, 169.14, 806, 52/303, 799, 641, 408; 428/180, 178, 116

[56] References Cited

U.S. PATENT DOCUMENTS

| | | | |
|---|---|---|---|
| 2,330,941 | 10/1943 | Acuff, Jr. | 52/407 |
| 3,307,312 | 3/1967 | Kreibaum | 52/303 |
| 3,364,639 | 1/1968 | Davenport | 52/309.15 |
| 3,445,322 | 5/1969 | Salia et al. | 52/169.14 X |
| 3,479,779 | 11/1969 | Ziegler | 428/178 X |
| 4,285,175 | 8/1981 | Struben et al. | 52/90 |

FOREIGN PATENT DOCUMENTS

| | | | |
|---|---|---|---|
| 2027387 | 12/1971 | Fed. Rep. of Germany | 52/199 |
| 2757200 | 7/1979 | Fed. Rep. of Germany | 52/169.14 |
| 542525 | 4/1956 | Italy | 52/199 |
| 1315334 | 5/1973 | United Kingdom | 52/199 |
| 2032986 | 5/1980 | United Kingdom | 52/199 |

*Primary Examiner*—Carl D. Friedman
*Assistant Examiner*—Naoko N. Slack

[57] ABSTRACT

A double cuspated surface plastic film is positioned between the base of a roof structure and the roof covering material so as to provide a multitude of venting air passages under the roof covering.

4 Claims, 1 Drawing Figure

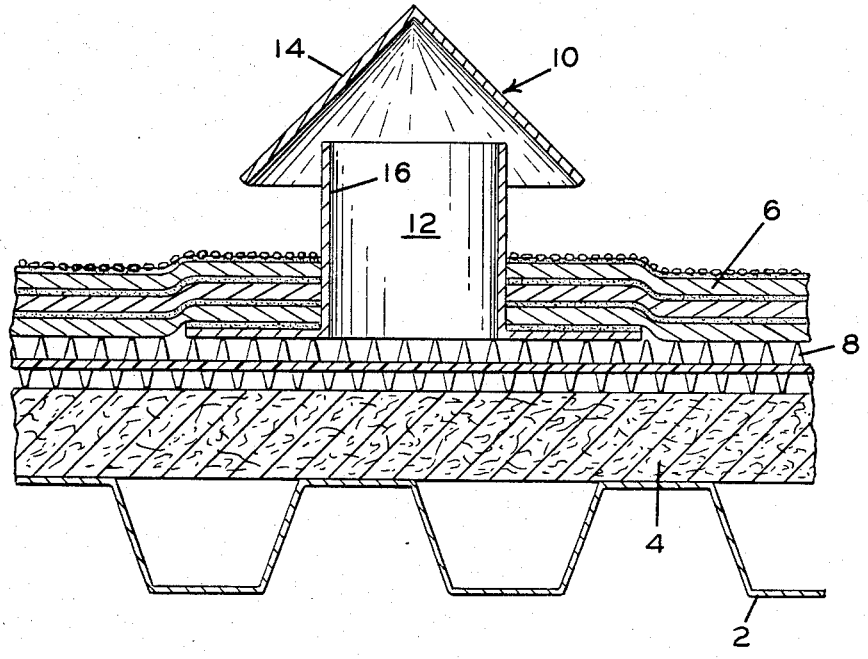
14
10
16
12
6
8
4
2

POSITIVELY VENTED FLAT ROOF SYSTEM

BACKGROUND OF THE INVENTION

1. Field of the Invention

The invention is directed to a flat roof structure and more particularly a roofing membrane which is vented to permit trapped moisture to escape.

2. Description of the Prior Art

U.S. Pat. No. 4,254,598 discloses a thermally isolated roof structure wherein a corrguated panel is nailed between the base of the roof structure and the roof covering material so as to provide a multitude of venting air passages under the roof structure.

U.S. Pat. No. 3,797,180 discloses a ventilating roof structure wherein a continuous corrugated sheet 24 is secured between the rafters and the roof deck.

U.S. Pat. Nos. 4,285,175; 3,364,639; 3,307,312; and 2,330,941 are other structures incorporating an insulating like material and a venting material and these structures are capable of use in roofing structures.

SUMMARY OF THE INVENTION

A ventilated roof structure is provided to permit the escape of moisture from between the roof membrane or outer portion of the flat roof and the metal decking forming the base of the roof structure.

Positioned between the insulation of the roof and the roofing plies forming the roof membrane is a double cuspated surface plastic film which forms a plurality of pathways to permit movement of moisture. These pathways are connected with an appropriate roof vent and provide a positive and continuous ventilation of harmful water vapors either trapped in or trying to enter the roof system.

BRIEF DESCRIPTION OF THE DRAWING

The drawing is a cross section of a ventilated roof system.

DESCRIPTION OF THE PREFERRED EMBODIMENT

A conventional roof structure would be composed of a corrugated metal decking structure 2 which would be placed upon the trusses or joists forming the roof main support. Over top of the metal deck 2 there would be placed an appropriate amount of insulation 4. This is normally a rigid fiberboard insulation ranging in thickness from 1 to 2". Over top of this is normally placed several layers of roofing paper 6. The individual layers of roofing paper are bonded together by a conventional roofing tar or asphalt to form the roof membrane. Over top of the roofing membrane there may or may not be provided stones. Moisture vapor from the inside of the building and also water vapor leaking through the membrane of the roof may accumulate at the interface and in the insulation 4 and the roofing paper 6. This moisture is the principal culprit in roof failures. The moisture from the outside or inside of the building attack the roofing plies and cause deterioration therein in the form of blisters, then leaks, and then finally failure of the roof structure. The essence of the invention herein is the placement of a uniquely formed thermal plastic film and vents within an assembly of available roofing materials in such a manner as to provide positive and continuous ventilation of harmful water vapors either trapped in or trying to enter the roof system. The logic of the system is the same as that of a traditional attic where positive ventilation permits wood, thatch, or a variety of other organic materials to serve for many years as effective roofing materials. The double cuspated surface of the film which is used herein will provide continuous ventilating tracks allowing moisture to escape immediately through vents, therefore eliminating the major cause of roof deterioration.

The double cuspated surface plastic film 8 is positioned in the roof structure on top of the insulation and underneath of the roofing plies which form the roof membrane. This cuspated surface plastic film is conventional in the art and is sold under the tradename "Hitek" by the Australian Applied Research Centre. The structure of the material is basically that of a base layer which has projecting from both sides thereof cone shaped plastic projections. The plastic projections are approximately $\frac{1}{8}$" in height and are provided at a density of approximately 81 projections or cones per square inch per side of the plastic film base layer. The points of the lower cones rest upon the insulation and the roofing plies are supported on the points of the upper cones of the plastic film 8. Consequently, the area between the cones forms passages for water vapor to move through. Other constructions for element 8 may be used. Cylindrical, square, etc. projections may be used on the conical or cuspated surface.

The roof is provided with roof vents 10 at selected positions along the roof. For a conventional small commercial structure one roof vent down the center of the structure would be adequate. As shown in FIG. 1, the passageways of the double cuspated plastic film will interconnect with the main body portion 12 of the vent which is covered by a cap 14 and then vapor can escape from the main body region 12 out into the atmosphere by passing between a small space between the cap 14 and the side wall 16 of the vent. Vents of this nature are conventional in the art. The vent could be at a single location or it could be at a plurality of locations strategically placed throughout the roof structure.

What is claimed is:

1. A ventilating roof system for providing positive and continuous ventilation of harmful water vapors from the roof system, said harmful, water vapors being generated above and below the roof system, comprising in combination:

(a) a roofing deck providing the bottom structure of the roof system, (b) positioned over the roofing deck there being provided fibrous insulation material, (c) positioned over the fibrous insulation material there being provided a roofing membrane consisting of plural layers of roofing felt bonded together by a conventional roofing tar adhesive to form a water tight membrane, and (d) the improvement comprising:

(1) a double cuspated surface plastic film means being positioned between the insulation and roofing membrane to form a plurality of positive and continuous ventilating passageways both above and below the membrane to permit the escape of water vapor from the region below the roofing membrane.

2. A ventilating roof structure as set forth in clam 1 wherein:

(a) the double cuspated surface plastic film means is composed of a base layer and projecting from both sides thereof a plurality of cone shaped projections to form said positive and continuous ventilating passageways both above and below the membrane.

3. A ventilating roof structure as set forth in claim 2 wherein:

(a) the cone structures of the double cuspated surface plastic film means are approximately ⅛" in height and are of a density of approximately 80 cones per square inch on both sides of the base layer of the plastic film means.

4. A ventilating roof structure as set forth in claim 3 wherein:

(a) a conventional roof vent interconnects the double cuspated surface plastic film and the exterior of the roof above the roofing membrane to provide venting of the postive and continuous ventilating passageways of the double cuspated surface plastic film to the area above the roof membrane.

* * * * *